United States Patent [19]

Rainville

[11] Patent Number: 4,577,798

[45] Date of Patent: Mar. 25, 1986

[54] METHOD OF FABRICATING EXPANDED SANDWICH PANELS HAVING AN ENCLOSED CORE

[75] Inventor: Gilles Rainville, Northridge, Calif.

[73] Assignee: Rockwell International Corporation, El Segundo, Calif.

[21] Appl. No.: 553,661

[22] Filed: Nov. 21, 1983

[51] Int. Cl.[4] ..... B23K 31/00

[52] U.S. Cl. ..... 228/157; 156/197

[58] Field of Search ..... 228/157; 156/197; 493/312, 966

[56] References Cited

U.S. PATENT DOCUMENTS 3,011,672 12/1961 Vesak ..... 156/197 X 3,644,158 2/1972 Strumbos ..... 156/197

4,217,397 8/1980 Hayase et al. ..... 228/157 X 4,242,161 12/1980 Hultén et al. ..... 156/197

4,361,262 11/1982 Israeli ..... 228/157 X

*Primary Examiner*—Kenneth J. Ramsey

*Attorney, Agent, or Firm*—Charles T. Silberberg

[57] ABSTRACT

The invention concerns novel close-outs for sandwich structures and fabrication methods. The sandwich structures are formed by superplastic forming, accordion expansion, or a combination thereof. The close-out structure is formed from a plurality of flat sheets and members of predesigned shapes and sizes that are positioned in such a manner as to form high strength structures after unfolding and expansion. The corners of the close-out structure are either rounded or angled.

12 Claims, 7 Drawing Figures

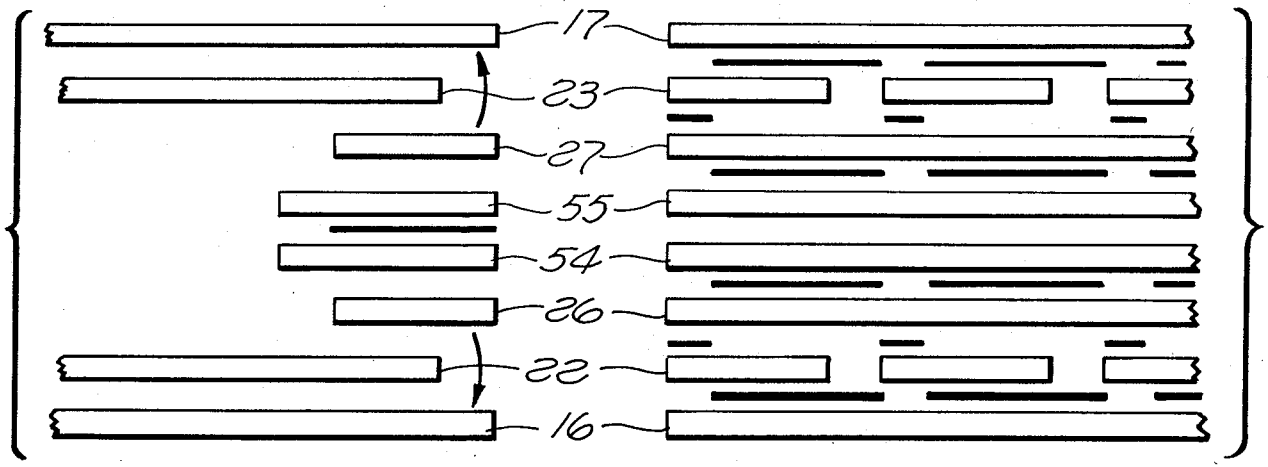
FIG. 5
FIG. 6
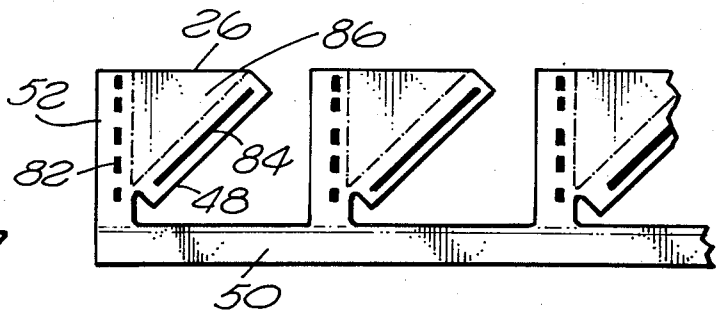
FIG. 7

METHOD OF FABRICATING EXPANDED SANDWICH PANELS HAVING AN ENCLOSED CORE

BACKGROUND OF THE INVENTION

The invention pertains to close-outs for sandwich structures which have either rounded or angled corners, the corners being formed by unfolding and expanding.

During recent years, sandwich structures have attained widespread use in the aircraft industry in wings, wall panels, beam webs, propeller and engine blades, stablizers and stabilators, and control surfaces.

Superplastic forming properties are exhibited by only a small number of materials and alloys, and the process involves the capability of a material to develop unusually high tensile elongations and plastic deformation at high temperatures with a reduced tendency towards thinning or necking. The workpiece is heated until it becomes superplastic, at which time a pressure differential is applied causing the workpiece to stretch into a desired shape. Aluminum alloys and titanium alloys exhibit good superplastic characteristics.

Diffusion bonding is often the preferred method of joining these superplastically formed workpieces. The method is a metallurgical joining of surfaces by applying heat and pressure for a time sufficient to cause commingling of the molecules at the joint interface. The basic requirement for diffusion bonding is to bring the clean mating surfaces close enough together to allow the inter-molecular attractive forces to become effective. A stop-off material is used to coat those portions of the surfaces where diffusion bonding is not needed. Diffusion bonding is accomplished entirely in the solid state.

However, superplastic forming, even when used with diffusion bonding, has several distinct disadvantages: (1) only the few materials which exhibit superplasticity may be used, (2) the structures must be raised to the high superplastic forming temperatures and pressures, (3) the considerable stretching produces structural distortions, and (4) the core thickness is limited since excessive stretching weakens the sandwich structure.

A novel forming process known as "accordion expansion" overcomes these disadvantages. The process is disclosed in U.S. application Ser. No. 466,987, entitled "Accordion Expansion Process" by Leonardo Israeli, which is incorporated into this specification by reference. This method makes sandwich structures by using two face sheets and a plurality of core sheets that unfold during the forming process. Although accordion expansion involves some stretching of the core sheets, the stretching is much less than what is involved in superplastic forming. Although accordion expansion occurs at elevated temperatures, such temperatures are generally lower than superplastic forming temperatures. A wide variety of materials (many of which cannot be used in superplastic forming) may be used in accordion expansion including aluminum, titanium, copper, and their respective alloys, and steel.

However, in order to fabricate completed sandwich structures by accordion expansion, it is also necessary to form the close-outs. Generally, sandwich structure must be substantially sealed and closed out. In addition to protecting the formed core, this close-out structure adds considerable strength to the sandwich structure. Although the close-out structure can be independently formed and assembled, it is preferred to form it in a one-step operation with the core sandwich. Furthermore, if the close-out structure is made of material similar to the core material in this one-step operation, the same temperature and pressure ranges can be utilized.

SUMMARY

It is an object of this invention to provide a sandwich structure having an enclosed core.

It is another object to provide a method of forming the close-out for a sandwich structure, whereby the close-out is formed in the same process as the overall sandwich structure.

It is yet another object to provide a sandwich structure having a close-out that seals and braces the sandwich structure.

The invention involves a novel close-out for a sandwich structure and methods of fabrication thereof. The sandwich structure may be made by superplastic forming or by accordion expansion. The close-out corners may be either rounded or angled. As used herein, the terms "rounded" and "angled" are mutually exclusive. "Rounded" refers to the shape of a continuously curved corner as is formed by the bending of a single sheet. "Angled" refers to the shape of a corner as is formed by the intersection of two flat sheets. The term "close-out" refers to the structure between the face sheets that encloses the core.

The close-out is fabricated by accordion expansion using two close-out core sheets which are substantially identical. Each close-out sheet has two lip portions. The close-out sheets and the lip portions are initially flat. The sheets may be joined by a variety of processes including the use of simple adhesives, brazing, or cold welding. Metallurgical bonding is preferred because of the similarity in composition between the bond and the surrounding metal.

Metallurgical bonding includes diffusion bonding, fusion welding, pressure welding, and similar processes. Diffusion bonding involves the solid state joining of metal surfaces by applying sufficient heat and pressure for a time that causes commingling of the molecules at the joint interface. Fusion welding involves the joining of metal surfaces by applying sufficient heat to cause the joint interface to reach the liquid state and merge into a unified whole. Pressure welding involves the joining of metal surfaces by applying pressure to cause commingling of the molecules at the joint interface.

Diffusion bonding is the preferred type of metallurgical bonding, and involves the application of a stop-off material between the sheets or workpieces prior to the unfolding to prevent bonding at preselected areas. Since almost all of the bonding is to occur along the lip portions, most of the remaining parts of the sheets are to be coated with the stop-off material.

The close-out structure is preferably perpendicular to the face sheets of the formed sandwich, but the close-out structure may also form an oblique angle relative to the face sheets. The close-out structure surrounds the core structure between the face sheets, thereby bracing and substantially sealing the core structure. The formed close-out structure has a central hole which is occupied by the formed core structure.

The method of forming the close-out structure involves accordion expansion. Accordion expansion is basically an unfolding process that involves some stretching. Stretching is only necessary to insure a substantially linear section formed by the combination of two core sheets. If the section is not substantially linear, the sandwich structure will be weakened, and unable to support large transverse loads. The stretching in accordion expansion varies depending on materials and parameters used but will not exceed one hundred percent. This is contrasted to superplastic forming, which is basically a stretching process, wherein stretching of up to and exceeding one hundred percent is not uncommon.

In forming angled close-out corners all of the close-out sheets are stretched less than fifteen percent (a preferred range of about five to ten percent), and so superplastic materials are not needed. In forming the curved portion of the rounded close-out corner, it is estimated that about thirty percent stretching is involved which also can be accomplished without superplastic materials.

The rounded close-out corners are preferably formed from a set of two close-out sheets. The two close-out sheets are substantially identical. Since the finished sandwich structure will normally have four corners, the preformed close-out sheets are in the shape of two flat picture frames. Each close-out sheet has two elongated lip portions, each lip portion also being substantially identical. One lip portion from each close-out sheet is joined to a lip portion from the other close-out sheet. The other two lip portions are joined to each of the respective face sheets.

The novel features which are believed to be characteristic of the invention, both as to its structure and its method of forming, together with further objects and advantages thereof, will be better understood from the following description in connection with the accompanying drawings in which presently preferred embodiments of the invention are illustrated by way of examples. It is to be expressly understood, however, that the drawings are for purposes of illustration and description only, and are not intended as a definition of the limits of the invention.

BRIEF DESCRIPTION OF THE DRAWINGS

FIG. 5 is an elevational view of the same embodiment shown in FIG. 4, showing the eight layers of sheets prior to accordion expansion.

FIG. 6 is another elevational view of the same embodiment shown in FIG. 5 prior to accordion expansion where the eight layers of sheets have been rotated ninety degrees.

FIG. 7 is a plan view of the tie members for a rounded corner or an angled corner of the close-out prior to accordion expansion.

DETAILED DESCRIPTION OF THE INVENTION

Figure 1:
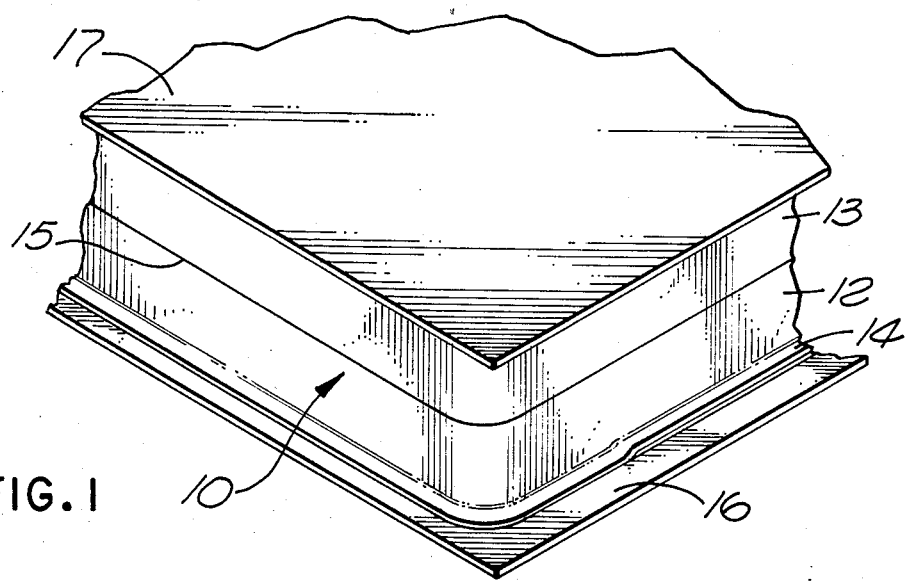
FIG. 1 is a isometric fragmentary view of the formed sandwich structure with a close-out having a rounded corner.

Referring now to the drawings, there is shown in FIG. 1 a rounded close-out corner 10 surrounded by two face sheets 16 and 17. The corner is formed by two rounded close-out sheets 12 and 13 that are metallurgically bonded together along respective mating lip portions 25 (see FIG. 2), forming rounded corner seam 15. Other lip portions 14 of rounded close-out sheets 12 and 13 are used to bond the close-out corner to each of the two face sheets 16 and 17 of the sandwich structure.

Figure 2:
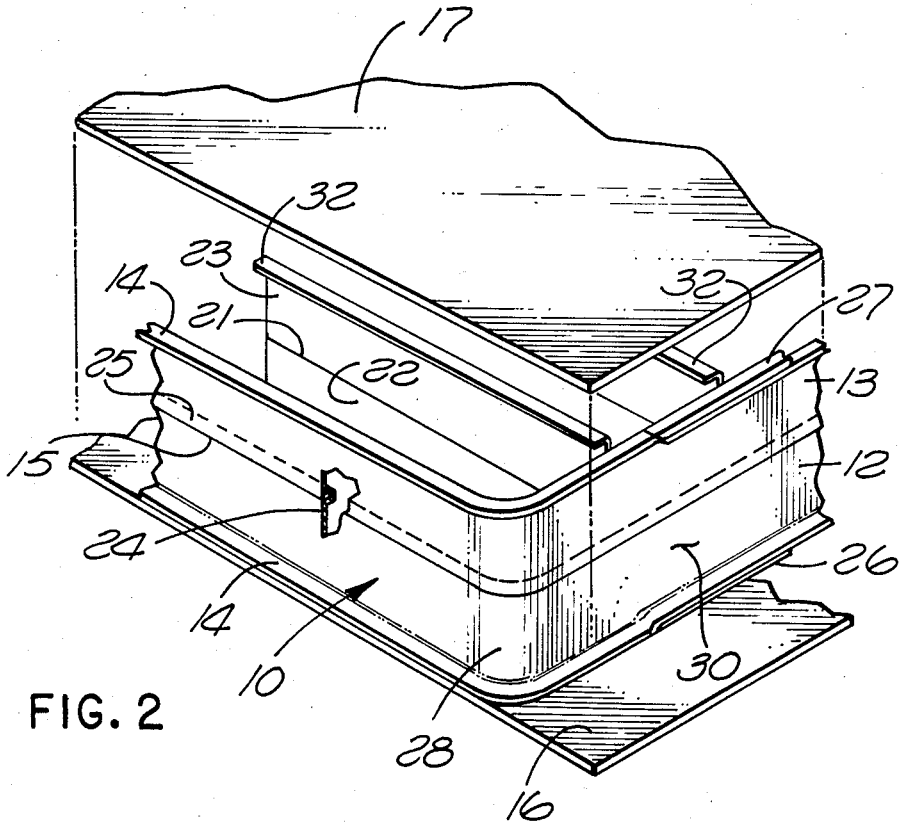
FIG. 2 is an isometric fragmentary assembly drawing of the same embodiment shown in FIG. 1, with one face sheet raised to show the relationship of the subject invention to a ribbed sandwich structure formed by accordion expansion.

The same basic structure is shown again in FIG. 2, except that the top face sheet 17 is lifted to better illustrate the structure. Under the face sheet 17 can be seen the core sheets 22 and 23 that form the core portion of the sandwich structure. The core sheets are comprised of two substantially identical core sheets 22 and 23 with cutout portions, each sheet having two lip portions 32 (at opposite ends) which are also substantially identical. Two lip portions (not shown) are used to metallurgically bond the two core sheets 22 and 23 together, forming seam 21. The other two lip portions 32 are joined respectively to each of the face sheets 16 and 17 to form the sandwich core structure.

All of the core sheets 22 and 23 with cutout portions are formed using accordion expansion. The only stretching (five to ten percent) involved is to insure a substantially linear and vertical core after unfolding, the core being capable of supporting large transverse loads. The flat portion 30 of the rounded close-out sheets 12 and 13 unfolds requiring between 5% and 10% expansion, whereas the curved portion 28 of the picture frame close-out sheets 12 and 13 unfolds, requiring between 20% to 25% expansion. Both the curved portion 28 and the flat portion 30 preferably have a substantially vertical section formed by the combination of the two rounded close-out sheets 12 and 13. The bonding of the two rounded close-out sheets 12 and 13 along lip portion 25 form lip seam 15. The tie members 26 and 27 are identical to those shown in FIG. 4.

To form the sandwich close-out structure with a rounded corner, eight layers of sheets and members are needed. These layers from top to bottom are as follows:

| | |
|---|---|
| 1. upper face sheet | (17) |
| 2. upper core sheet | (23) |
| 3. upper tie member | (27) |
| 4. upper rounded close-out sheet | (13) |
| 5. lower rounded close-out sheet | (12) |
| 6. lower tie member | (26) |
| 7. lower core sheet | (22) |
| 8. lower face sheet | (16) |

Figure 3:
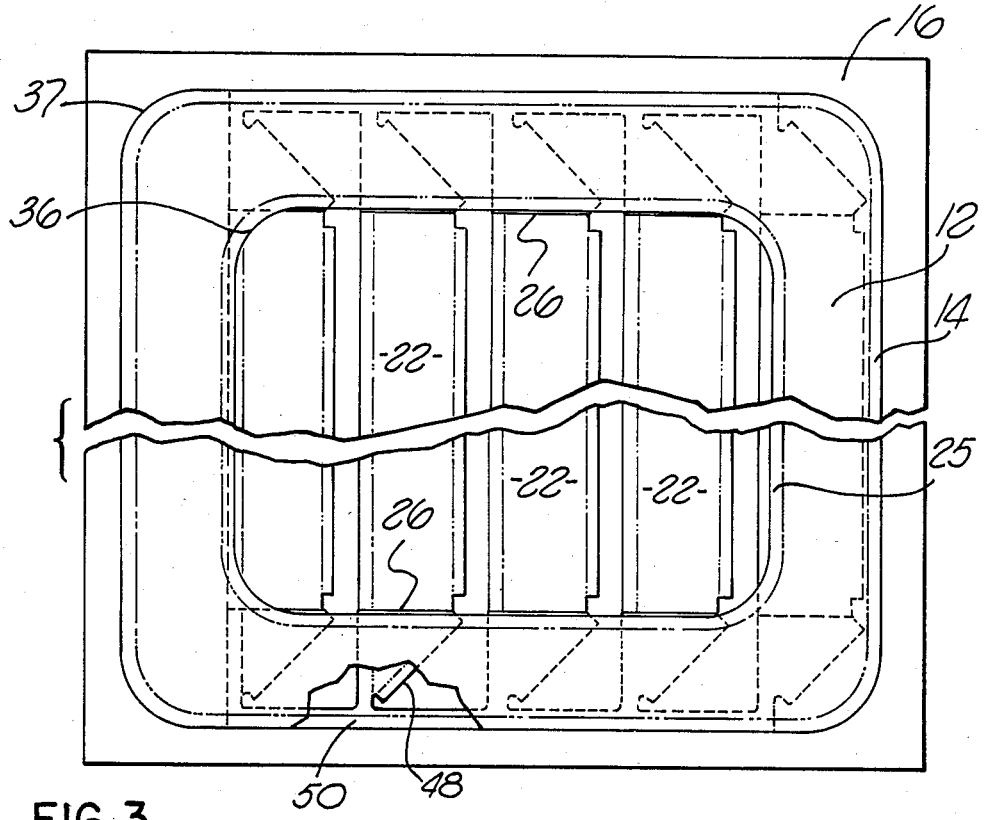
FIG. 3 is a plan view showing the relationship of the lower face sheet, the lower close-out sheet, the lower tie workpieces, and the lower core workpieces prior to the unfolding and expanding steps.

A plan view is depicted in FIG. 3 showing the lower four layers, and their relationship to each other prior to the unfolding and expanding steps. The lower rounded close-out sheet 12 covers the two lower tie members 26 (one at each end) which are connected together by lip portions 50. The lower tie members 26 cover the lower core sheets 22 (five are shown) which in turn cover the lower face sheet 16.

The lip portion 40 of the tie members 26 covers the lip portions (not shown) of the lower core sheet 22 prior to the forming step. During the forming step the two lip portions are joined, so that preferably the angle of the lip portions is about 45°. In the preferred embodiment more stretching is required at the rounded curve portions 28 (20% to 25%) than at the flat portions 30 (5% to 10%). Since it is preferred that both the rounded curve portions 28 and the flat portions 30 are substantially vertical after expansion, it is necessary that there be more material prior to expansion in the rounded close-out sheets 12 and 13 at the flat portions 30 than at the rounded curve portions 28. These requirements are satisfied if the radius of curvature of curve 37 is greater than the sum of the radius of curvature of curve 36 and the thickness of the rounded close-out at the rounded curve portion.

Figure 4:
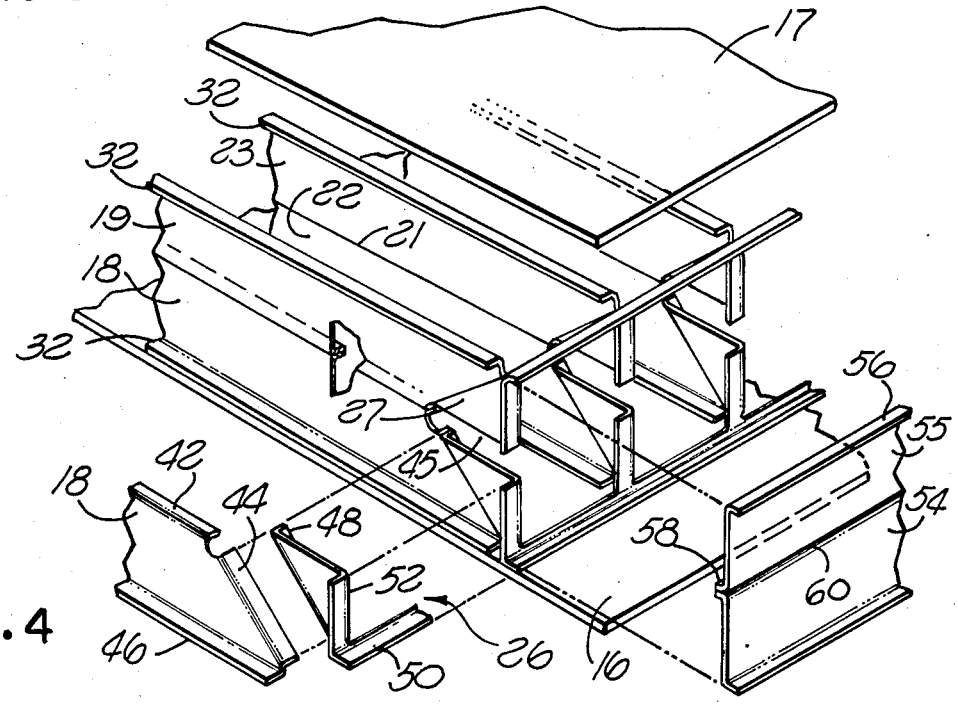
FIG. 4 is an isometric fragmentary assembly drawing of the formed sandwich structure having a close-out with an angled corner, with one face sheet raised, showing the relationship of the members and sheets.

Angled close-out corners are similar to the rounded close-out corners, but involve more close-out sheets. Referring to FIG. 4, a formed sandwich core close-out structure having an angled corner is depicted, and again as in FIG. 2, the top face sheet 17 is lifted from the structure to better illustrate the structure.

The angled close-out corner is made from assembling together six different pieces: two angled close-out sheets 54 and 55, two angled close-out sheets 18 and 19 with cutout portions, and two tie members 26 and 27. In this embodiment the angled close-out sheets 18 and 19 with cutout portions, are identical to the core sheets 22 and 23 with cutout portions. In this drawing the vertical core is formed by the accordion expansion process, and is similar to the structure shown in FIG. 2. The tie members 26 and 27 have a lip portion 48 that is joined to lip portion 44 of core sheet 22. Lip portion 52 of the tie member 26 is joined to angled close-out sheet 54, and lip portion 50 of tie member 26 is joined to face sheet 16, and close-out sheet 54, and also serves to connect the tie members together.

Core sheets 22 and 23 are joined to face sheets 16 and 17 by lip portion 46, and core sheets 22 and 23 are joined together by lip portion 42 forming seam 21. Angled close-out sheets 54 and 55 are joined together by lip portions 58 forming angled corner seam 60. Angled close-out sheets 54 and 55 are joined to the tie members 26 and 27 along lip portions 56.

The formed angled close-out corner leaves a gap 45 between the two tie members 26 and 27. If a sealed close-out structure is needed, a plug (not shown) having the general shape of gap 45 may be inserted into the gap 45 and joined thereto after unfolding.

FIGS. 5, 6, and 7 are herein grouped together. FIG. 7 depicts a plan view of the lower tie members 26, prior to the expanding step. The preferred method of joining is metallurgical bonding and the preferred method of metallurgical bonding is diffusion bonding.

Diffusion bonding requires the selective application of stop-off material along those surfaces where there is to be no bonding. Since the plan view shown in FIG. 7 looks down on the tie member, the surface seen will be referred to as the top surface, and the under surface will be referred to as the bottom surface. The top surface of lip portion 52 is to be bonded to the angled close-out sheet 54. The bottom surface of lip portion 52 is not to be bonded, so it must be coated with stop-off. The stop-off 84 on the top surface is shown as a solid line, whereas the stop-off 82 on the bottom surface is shown as a dotted line. Yttria ($Y_2O_3$) is a suitable stop-off which is applied in a binder by a silk screening process. The top surface of lip portion 48, is not to be bonded so it is coated with stop-off. The bottom surface of lip portion 48 is to be bonded to lip portion 44 of core sheet 22. The top surface of lip portion 50 is to be bonded to angled close-out sheet 54 and the bottom surface of lip portion 50 is to be bonded to face sheet 16. Both the top and bottom surfaces of the body 86 of tie member 26 are to be coated with stop-off (not shown) prior to forming.

FIGS. 5 and 6 show the layered stack of sheets and members for the sandwich close-out structure with an angled corner prior to expansion. FIG. 6 depicts the same sheets as FIG. 5 rotated ninety degrees counterclockwise. The eight sheet stack from top to bottom is as follows:

| | | |
|---|---|---|
| 1. | upper face sheet | (17) |
| 2. | upper core worksheet with cut-out portion | (23) |
| 3. | upper tie member | (27) |
| 4. | upper angled close-out sheet | (55) |
| 5. | lower angled close-out sheet | (54) |
| 6. | lower tie member | (26) |
| 7. | lower core worksheet with cut-out portion | (22) |
| 8. | lower face sheet | (16) |

FIGS. 5 and 6 show the stop-off patterns for the eight sheets (the stop-off is dark). The two face sheets 16 and 17 are bonded all along the lip portion 50 of tie members 26 and 27.

When the sheets are inserted into a stack, it is important to maintain small passageways (not shown) to the interior of the stack. The passageways are connected to a pressurized gas system during the expansion step. Inert gas, preferably argon, is used for reactive metal structures.

The stack can be heated to a suitable diffusion bonding temperature (about 1700° F. for Ti-6Al-4V) by heat generated from heating platens (not shown). Pressure is applied to the stack to effect the bonding. After the bonding has been completed, pressurized gas (from 100 to 500 psi for up to 15 minutes) is inserted and circulated through the passageways and the stack. The applied pressure will force the stack to inflate and fill up the die cavity with the two face sheets 16, against the upper and lower die surfaces respectively. Upon expansion, the angled close-out sheets 22 and 23, 54 and 55, and the tie members 26 and 27 will unfold, stretch, and bend about the joined areas to form the desired close-out for the sandwich structure. The accordion expansion temperature range for 6Al-4V titanium is from 1250° F. to 1700° F.

Accordingly, there has been provided, in accordance with the invention, sandwich core close-out structures and a forming method that fully satisfies the objectives set forth above. It is understood that all terms used herein are descriptive rather than limiting. While the invention has been described in conjunction with specific embodiments, it is evident that many alternatives, modifications, and variations will be apparent to those skilled in the art in light of the disclosure herein. Accordingly, it is intended to include all such alternatives, modifications, and variations that fall within the spirit and scope of the appended claims.

I claim:

1. A method of forming a sandwich structure with a core close-out, comprising:

providing two face sheets, each face sheet having two opposed principal surfaces;

providing at least one core sheet, said at least one core sheet having two opposed principal surfaces;

providing at least one set of close-out sheets, each sheet of said set having two opposed principal surfaces, and having substantially the same shape, each of said close-out sheets having a pair of elongated lip portions, each of said close-out sheets having a central hole;

positioning said sheets in a stack, contacting at said principal surfaces, such that said central holes of said close-out sheets are in alignment and said face sheets sandwich said close-out sheets and said at least one core sheet, said at least one core sheet being positioned within said central holes of said close-out sheets such that said close-out sheets substantially frame said at least one core sheet;

joining one of said lip portions from each of said close-out sheets together;

joining said other lip portion from each of said close-out sheets to the respective contacting face sheet;

joining at selected areas said at least one core sheet to said face sheets; and expanding the joined stack such that the core of said sandwich structure is formed by said at least one core sheet and said close-out sheets unfold into a core close-out that extends continuously around the periphery of the core.

2. The method of claim 1 wherein said joining is by diffusion bonding.

3. The method of claim 1 wherein said sandwich structure is formed by accordion expansion.

4. The method of claim 3 wherein said formed close-out is substantially perpendicular to said face sheets.

5. The method of claim 1 wherein each of said close-out sheets is comprised of four separate portions with each portion positioned adjacent to and substantially perpendicular to two of the other portions, and also including the steps of:

providing a plurality of tie members, said tie members each having two lip portions;

positioning said tie members relative to said portions of said close-out sheets; and joining said portions of said close-out sheets by use of said tie members with each of said lip portions of said tie members joined to one of said close-out sheet portions;

whereby said vertical core close-out has angled corners after said expanding step.

6. The method of claim 5 wherein said close-out sheets stretch less than fifteen percent during said expanding step.

7. The method of claim 1 wherein said close-out sheets have arcuate corners such that said vertical core close-out has arcuate corners after said expanding step.

8. The method of claim 7 wherein said close-out sheets stretch more than fifteen percent but less than thirty-five percent at the arcuate corners during said expanding step.

9. The method of claim 8 wherein said close-out sheets other than in the area approximately at said arcuate corners stretch less than fifteen percent during said expanding step.

10. The method of claim 1 wherein there are two core sheets and also including joining at selected areas said core sheets to each other.

11. The method of claim 10 wherein said formed close-out is substantially perpendicular to said face sheets.

12. The method of claim 1 wherein said formed close-out is substantially perpendicular to said face sheets.

* * * * *